United States Patent [19]

Benjamin

[11] Patent Number: 4,674,601

[45] Date of Patent: Jun. 23, 1987

[54] ACCESSOR

[76] Inventor: Murray Benjamin, 7 Cole St., Falmouth, Me. 04105

[21] Appl. No.: 750,017

[22] Filed: Jul. 1, 1985

[51] Int. Cl.[4] ..... B66B 9/00

[52] U.S. Cl. ..... 187/1 R; 414/921; 414/546

[58] Field of Search ..... 187/9 R, 1 R; 414/556, 414/921, 546, 545, 540, 537; 14/71.3

[56] References Cited

U.S. PATENT DOCUMENTS

| | | | |
|---|---|---|---|
| 3,874,527 | 4/1975 | Royce | 414/921 |
| 4,155,468 | 5/1979 | Royce | 414/921 |
| 4,265,586 | 5/1981 | Couture | 414/921 |

*Primary Examiner*—Joseph J. Rolla
*Assistant Examiner*—Kenneth Noland

[57] ABSTRACT

Apparatus for enabling wheelchair-confined individuals to more easily convey themselves between two different elevations, especially between the inside ground level of a house and the outside ground level. The key to the invention is a unitary molded lift or scoop on which the wheelchair rides while being conveyed between the two levels. This lift is formed so as to maintain the wheelchar seat in a horizontal orientation during transit. The lift is mounted in a frame in which also resides the peripheral equipment needed to raise and lower the lift. The lower end of the lift is attached to a pair of cables which pass up to and through the top of the frame and then around the take-up reels. The opposite end of the lift is attached by a hinge to the frame at the level of the higher elevation. In its preferred embodiment, the lift conveys the wheelchair between the interior of the ground floor of a house and the ground level outside.

3 Claims, 4 Drawing Figures

ACCESSOR

BACKGROUND OF THE INVENTION

1. Field of the Invention

The present invention provides wheelchair users a more efficient means than has existed heretofore of ingress to and egress from buildings or free standing outdoor or indoor structure, as well of transit between sections of buildings, where said ingress and egress and said transit involve a change in elevation. The invention is centered on a unitary, molded, movable arcuate ramp on which the wheelchair rolls forward or back maintaining a fixed orientation while being raised or lowered, respectively. During the lifting phase, the Accessor moves the wheelchair forward at the same time it lifts it upwards, so as to deliver the wheelchair directly inside or onto the structure to be entered.

2. Description of Prior Art

Several earlier systems going beyond simple fixed ramps have been devised to aid wheelchair-confined persons to traverse changes in vertical position or location. For the most part, these systems have consisted of flat elevator platforms which, while solving the stair by-passing problem, tend to be considerably more cumbersome than the present invention and furthermore do not address the ingress/egress problem concurrently with the raising or lowering of the wheelchair. The prior art which comes closest to the present invention is the "Vehicle Mounted Access Ramp for Wheelchair Users" on which various Letters Patent were issued to Robert H. Royce. That system reversibly lifts and advances a wheelchair into a van interior utilizing a multiple-piece ramp/lift assembly. Royce's invention is strictly limited to use with vans and incorporates several aspects which make it awkward to adapt to use with an enclosed structure or a free-standing stationary structure. Attention is called to U.S. Pat. Nos. 4,155,468, 3,913,759, 3,874,527, 3,711,882, 3,411,169, and 1,034,061.

SUMMARY OF THE INVENTION

The primary object of the invention is to provide wheelchair-confined individuals, and especially those more severely handicapped, increased control over an important aspect of their lives, namely entry and exit from their own homes. The intention is to provide convenient access without the necessity of cumbersome and unsightly elevator equipment on the exterior of the house. The core of the Accessor is the strong, lightweight, molded unit on which the wheelchair rides while being lifted or lowered. The remainder of the device consists of equipment peripheral to and supportive of this lift module. Said equipment is hidden from sight in a framework which forms an integral part of the house on and in which the Accessor operates. Consequently, when the unit is in its up/closed position, the only evidence of its presence is a smooth bubble-shaped bulge on the side of the house on which it is mounted. When it is fully deployed, the Accessor has an appearance from without which is only slightly different from that of the fixed ramps now appended to numerous buildings in order to provide wheelchair access. One difference is that in this case the "ramp" leads directly into the house, with no need for negotiating a door or other barrier. Once the wheelchair has been lifted it rolls directly into the home to be entered. The convenience of the device depends to a certain extent on the particular shape given to the lift unit. It is shaped so that the wheelchair rolls forward at the same time it is being conveyed up or down. The surface on which the wheelchair rolls is partially cylindrical. In particular, the central portion of that surface is cylindrical, with the cylinder axis perpendicular to the direction of travel of the wheelchair; the radius of curvature is four feet in the preferred embodiment. On the other hand, the end of the ramp farthest from the house when the lift is fully deployed (the distal end) is flat for approximately one-anda-half feet. Thus, when the wheelchair rolls onto the distal end of the ramp all four wheels of the wheelchair will be tangent to the ramp in the same plane. In other words, the wheelchair in that starting position will be completely level. It will in fact remain completely level with its seat horizontal throughout the trip, in contrast with the situation which prevails for a wheelchair traversing a fixed ramp in order to change elevation. The end of the ramp opposite from the distal end (the proximal end) is attached to the house via an axle/hinge in such a way that the ramp pivots about that end as it is raised or lowered. The proximal end, like the distal end, is flat. However, the length of the flat section varies with the installation and in this way the Accessor can be adapted to provide a range of vertical excursions.

To enter his or her house by means of the Accessor, the wheelchair user first lowers the ramp from outside the house. This is accomplished by any of a number of methods. One is by the use of microwave-controlled apparatus similar to that used on "radio-controlled" garage doors. (In fact, exactly the same apparatus is incorporated into the preferred embodiment of the Accessor.) Once the ramp has been lowered, the wheelchair occupant is presented with a flat section of ramp (as noted above) covered with skid-resistant material onto which he or she can advance the wheelchair. Next, a command similar to that required to lower the ramp is utilized in order to initiate the closing and lifting of the ramp. The ramp is lifted by means of motor-driven cables which extend through the house wall (above the frame housing the ramp) to the distal end of the ramp. The take-up reels commence when the close command is given. At that point the lift, with the wheelchair on it, slowly rises. The nature of the forces on the wheelchair as the lift closes tend to roll the wheelchair forward as it is being lifted. In this manner, by the time the lift has closed to the extent that the flat section at the proximal end of the lift is horizontal, the wheelchair is on that section and prepared to roll on into the house as the lift finishes closing, sealing the opening in the house. (As needed, the ramp [which constitutes a part of the house's outside wall] will be thermally insulated.)

For exiting the house, the wheelchair occupant activates the raising/lowering motor so as to lower the ramp. The system is designed to move sufficiently slowly that the wheelchair can be leisurely rolled forward onto the ramp while the proximal flat section is horizontal (and parallel with the inside floor). Once aboard the ramp, forces similar to those encountered during the raising process cause the wheelchair to slowly roll forward as the ramp is lowered, in such a manner that when the ramp is fully deployed the wheelchair is residing squarely on the flat section at the distal end of the ramp. From there, in a continuous motion without stopping, the wheelchair can then be rolled off the ramp and the ramp closed.

PREFERRED EMBODIMENT OF THE INVENTION

Figure 1:
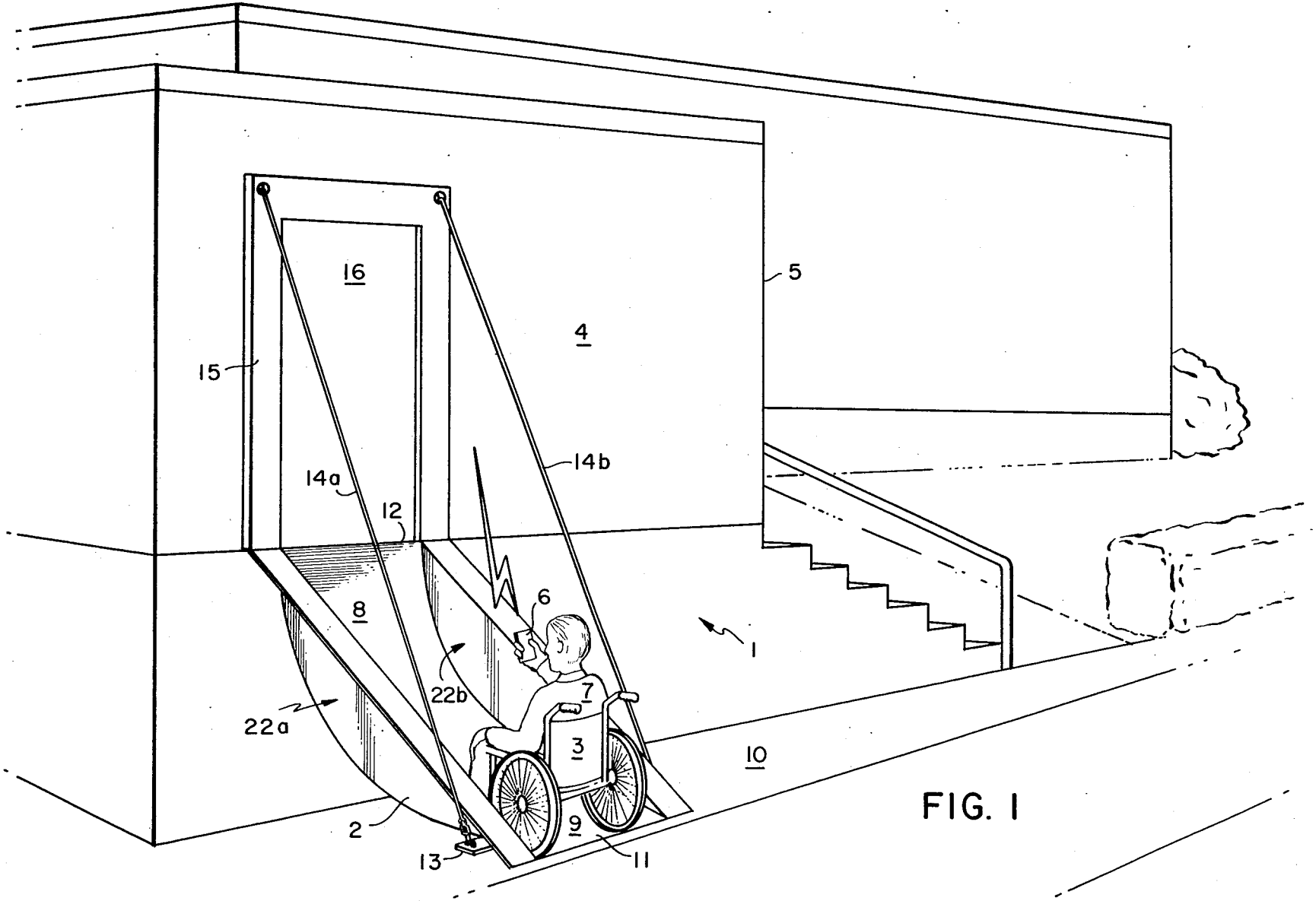
FIG. 1 is a a perspective view of the invention Accessor attached to a dwelling.

Referring to FIG. 1, an Accessor 1 is depicted, the heart of which design is a curved ("arcuate") lift 2 on which a wheelchair 3 rides while being elevated or lowered. As indicated in the SUMMARY and the CLAIMS, all applications of this design to fixed structures are sought to be covered by U.S. Letters Patent. Of these various applications, the preferred embodiment is the form of the Accessor adapted for entering and leaving a house. It is this embodiment which will be set out in detail in this section.

In its preferred embodiment, the Accessor 1 is intended to aid wheelchair-confined individuals to gain easy entrance to and exit from their homes. In order to effect this function, the Accessor 1 is mounted in a wall 4 of a home 5 as an auxillary entrance/exit, arcuate lift 2 acts as a door which lowers itself on command e.g. by control means 6 to allow a wheelchair occupant 7 to roll onto an inner surface 8 of the lift 2 and thence to be transported upward and inward upon a subsequent command. The control means 6 may be operated by manual means, manually-triggered electrical means, or radio-triggered electrical means. This provides for alternative power sources in case of power failure. The arcuate lift 2 is partially planar and partially curved so as to facilitate this action. A section 9 of the lift 2 onto which the wheelchair 3 is rolled from without is flat (planar) such that when the arcuate lift 2 is fully deployed this section is flush or nearly flush with ground surface 10, and the wheelchair 3 can be rolled smoothly onto it. Being away from the house 5 when the Accessor 1 is deployed, and adjacent this section 9 is a distal end 11; opposite end 12 is proximal since it is closer to the house 5. A flat strap 13 made of metal or other durable and strong material passes in a supporting fashion beneath the distal end 11 and is fastened at its extremities to separate cables 14*a*, 14*b* which in turn run up to and around takeup reels (see FIG. 2*a*) installed in Accessor frame 15 on either side of arcuate lift opening 16. The cables 14 should have approximately 800-pound test capabilities.

Figure 2A:
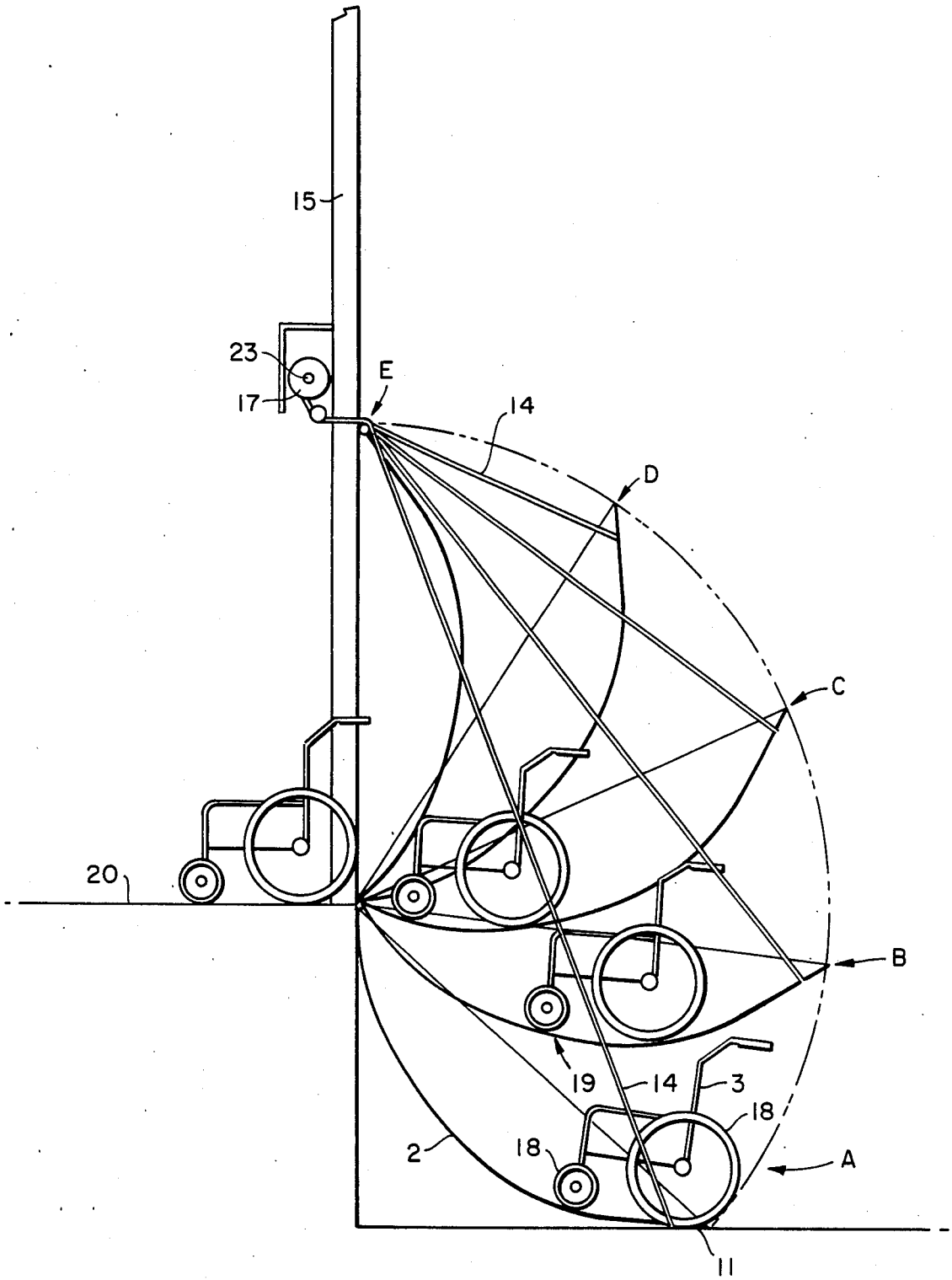
FIG. 2*a* is a schematic view of the invention depicting various positions of the Accessor and wheelchair while increasing elevation.

As seen in FIG. 2*a*, reels 17 are mounted on an axle 23 as attached to frame 15. The axle 23 and reels 17 are rotated in order to retract or deploy 14 attached to the lift 2. Said axle is coupled to an electric motor as well as to a manually operated crank. As the arcuate lift 2 is first reeled in and up in this manner while the distal end 11 is supporting a wheelchair 3, said distal end 11 begins to tilt up and away from the horizontal in such a way that the wheelchair is shifted forward. For use with the Accessor 1, a wheelchair 3 is positioned on the distal end 11 with its wheels 18 unlocked as depicted in position A. Being therefore free to roll, it does roll—onto a middle section 19 of the arcuate lift—during retraction of the lift as shown in position B. The middle section 19 of the arcuate lift 2 is cylindrical in shape and so formed that it presents a concave surface with approximately a 48" radius of curvature to the wheelchair 3. The curved nature of the middle section 19 of the arcuate lift 2 thus enhances the smooth rolling advance of the wheelchair 3 as the arcuate lift 2 continues upward through positions C, D, and E finally depositing the wheelchair 3 onto floor 20 of the house. This particular radius of curvature was chosen as the minimum consistent with the front of the wheelchair not striking the surface of the arcuate lift 2 as the wheelchair moves forward. (Another condition is that the wheelchair seat remain horizontal throughout the lifting process, a condition which is satisfied by this lift shape provided that the wheelchair is free to roll under the force of gravity.) If the radius of curvature is too small, the front of the wheelchair frame will strike the arcuate lift surface as the wheelchair moves forward. On the other hand, if the radius of curvature is substantially larger than the minimum required, the arcuate lift itself is unnecessarily large and the general design reduced in flexibility with respect to adaptation for small vertical increments. The function of the curved section of the arcuate lift is both to establish the angular difference (70 to 81 degrees, depending on model) between the respective orientations of the distal and proximal planes and incidentally to provide a vertical drop when the arcuate lift is deployed. Ignoring the constraints imposed by the finite distance between the front and rear wheelchair axles, one could provide a transition section with a far smaller radius of curvature; however, this would reduce the vertical elevation change over which the Accessor operates for given distal and proximal plane lengths.

Figure 2B:
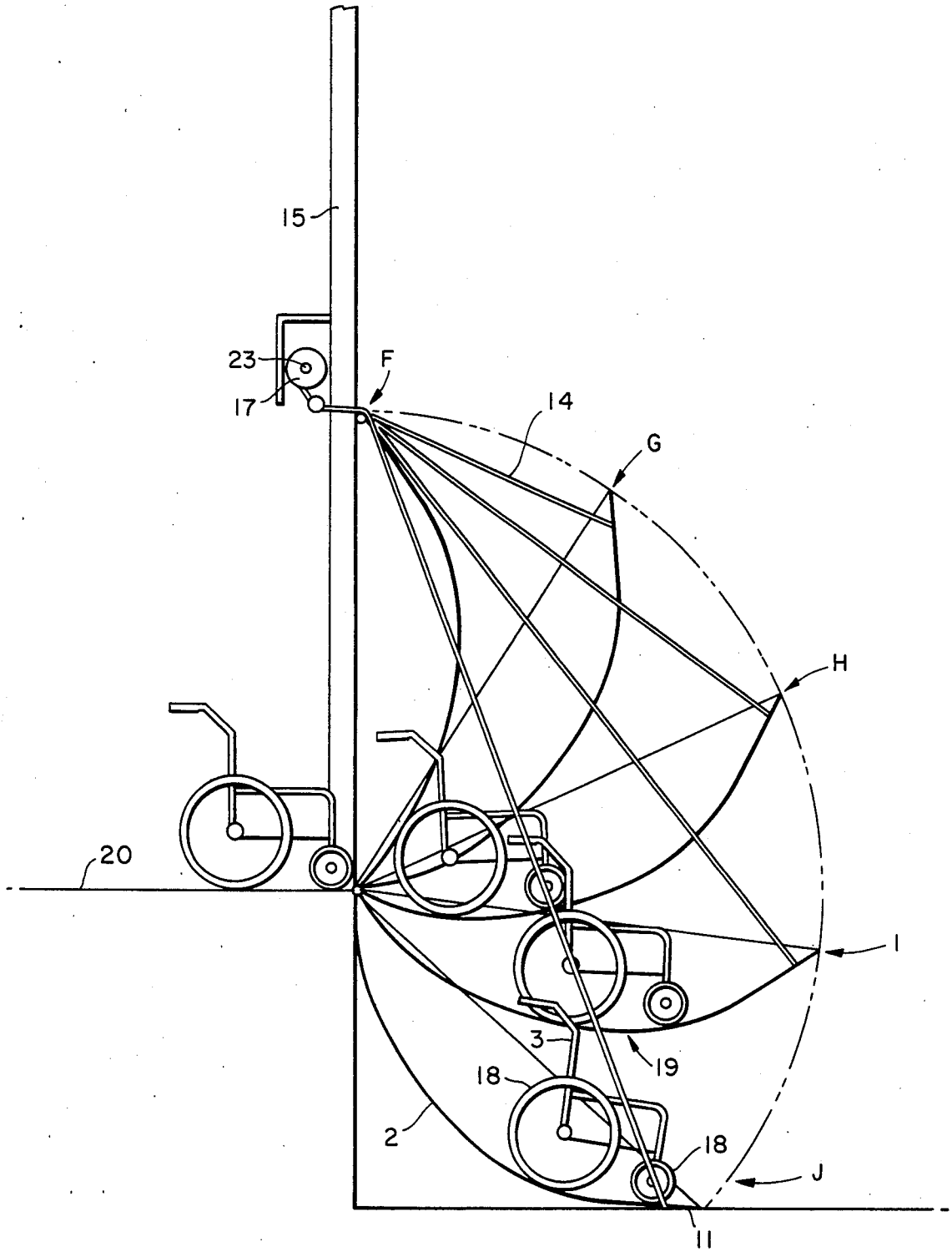
FIG. 2*b* is a schematic view of the invention depicting various positions of the Accessor and wheelchair while decreasing elevation.

Referring to FIG. 2*b*, the Accessor's use in decreasing elevation is shown. The wheelchair 3 would enter arcuate lift 2 on flat, planar area 9 at upper position F. Again the wheelchair 3 is free to roll with its wheels unlocked and is positioned on the proximal end 12. As the lift 2 is lowered as shown in position G, the wheelchair 3 rolls onto the middle section 19 of the lift 2. As the wheelchair's elevation is lowered the wheelchair continues to roll through positions H, I and J finally being deposited at the lower level.

The lift is designed so that with the change of a single parameter during the manufacturing process (namely, the length of the flat section at the proximal end) one basic shape can be adapted to a wide range of vertical transfer situations. The distal end is flat for a length of approximately 2.5'. Except for those arcuate lifts designed for the shortest vertical increments the flat section at the proximal end makes an angle of approximately 80 degrees with the distal end plane. The curved mid-section of the arcuate lift is cylindrical with a radius of curvature of approximately 48". The final arcuate lift-design constraint is the requirement that when fully deployed the arcuate lift shall project a maximum distance of about 6.5' from the wall of the house. For example, the arcuate lift having a proximal planar section 51" in length can provide wheelchair transfer over a vertical elevation change of from 90" (for which the distal plane is horizontal at full deployment and the proximal plane nearly vertical) to 96" (for which the distal plane is not quite horizontal and at full deployment and the proximal plane makes an angle of 8 degrees with the vertical). At the other extreme within the context of the preferred embodiment, a lift with a proximal plane only 9" long can cover elevation changes from 36" (for which the distal plane is horizontal and the proximal plane makes a 22 degree angle with the vertical) to 41" (where the distal plane departs somewhat from the horizontal). See FIG. 4.

Figure 3:
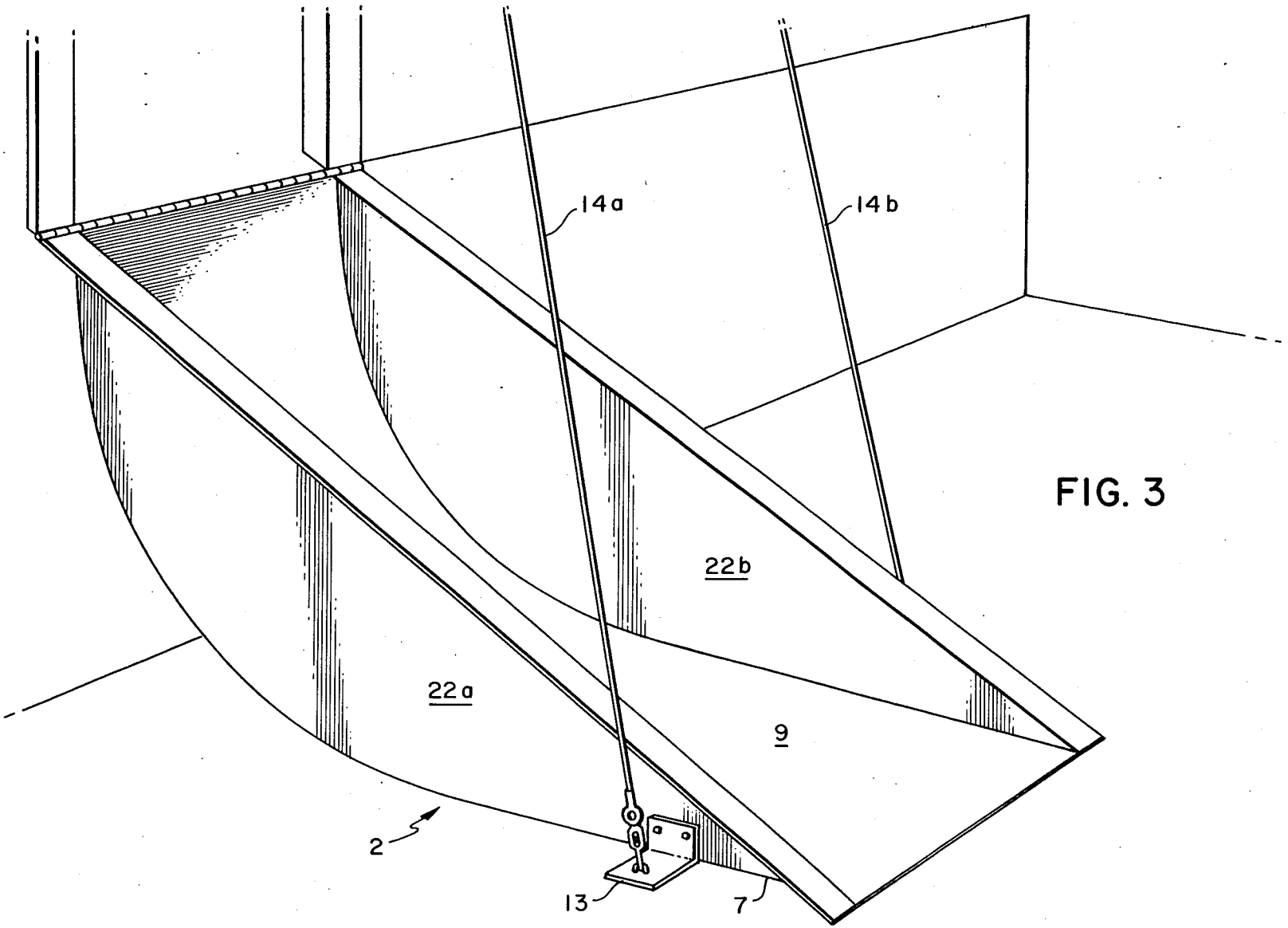
FIG. 3 is a closeup perspective view of the invention Accessor shown in a completely open position.

In the preferred embodiment the arcuate lift is manufactured from a strong lightweight synthetic resin. This provides certain economies in the mass production of the Accessor, since once a mold has been made, it can be used to produce many arcuate lifts. Another material which has certain advantages when used to make the arcuate lift is a lightweight metal such as aluminum. In either case (synthetic resin or lightweight metal), the arcuate lift, in addition to being shaped with the rolling surface shape set out above, is provided with sides 22*a* and 22*b* as indicated in FIGS. 1 and 3. These sides 22 provide both additional strength and additional safety (in the form of a barrier against the wheelchair inadvertantly rolling off the lateral edge of the lift). In addition, cross-struts of material are added as needed (probably only with the aluminum lifts) in order to bring the total bearing strength of the lift to a minimum of 800 pounds, so that the arcuate lift will have a failure strength greater by at least a factor of two than the gross load the lift is designed to carry.

Well-known technology will be used for raising and lowering the arcuate lift. As indicated in FIG. 5, cables 14 running to a flat strap 13 passing under the distal end 11 will be used to transmit both lifting force and a controlled lowering to the arcuate lift. That is, the deployment and retraction will be effected by reeling the cables out and in, respectively, so as to lower or lift the distal end 11 of the arcuate lift 2. The cables themselves 14, in the preferred embodiment, will consist of flexible stranded steel, approximately 5/32" in diameter and will be coated with a plastic substance in accord with known technology. The design of these reels and peripheral apparatus will be in accord with known technology, and will in fact be very similar to the apparatus used to lift and lower garage doors, down to and including the radio-controlled features of present automatic garage doors. As indicated, the two take-up reels will be mounted on a single axle. Said axle will be turned by an electric motor geared down so as to achieve a deployment/retraction rate of 30 rpm, which will result in an approximate time for total deployment or retraction of one minute for the mid-sized model. Safety provisions will include a manual back-up for the electric motor.

Also, the Accessor will have sealing capabilities to the structure to which it is attached; i.e., the Accessor will be able to seal tightly with the structure so very little or no loss of heat or cold would occur at the point at which the Accessor joins the structure. Also, insulative qualities could be incorporated into the entire arcuate lift in addition to just the sealing area so as to provide further reduction in total heat loss.

I claim:

1. In combination with an enclosed structure, a device for vertically conveying a wheelchair and its occupant between two levels of said structure thereby providing both ingress to and egress from the ground level of said structure, comprising:

(a) a solid arcuate lift on which said wheelchair rollingly rests while being conveyed between said two levels wherein said arcuate lift is molded from lightweight material containing flat surfaces at said arcuate lift's two extremities, between which said arcuate lift is cylindrical in shape having a constant radius of curvature;

(b) means for pivotally attaching a proximal end of said arcuate lift at the height of the floor of the upper of said two levels linked by the device to said floor;

(c) means for reversibly lifting a distal end of said arcuate lift upwards and inwards so as to convey said wheelchair upward and forward thereby delivering said wheelchair to the upper of said two levels of said enclosed structure and in reverse, so as to convey said wheelchair downward and forward thereby delivering said wheelchair to the lower of said two levels, said arcuate lift serving, as the wheelchair is moved from one level to another, to maintain the wheelchair seat in a substantially horizontal orientation;

(d) control means for activating said arcuate lift from either level and from said arcuate lift itself;

(e) at least one backup safety mechanism to permit a controlled change in level of said arcuate lift.

2. The invention claimed in claim 1 wherein said means of reversibly changing said level of said distal end of said arcuate lift comprises a strap which passes under said distal end of said arcuate lift and is attached to cables which pass upward to and through dual openings in the facing wall, one to each side of the path of said arcuate lift there to be wound on reels mounted on an axle driven by electrical means with manual backup system so as to both reel in said cables and hence lift said distal end and feed out said cables in a measured fashion so as to permit said arcuate lift to lower under the force of gravity.

3. The invention claimed in claim 2 wherein said means of pivotally attaching said proximal end of said arcuate lift comprises a hinge axis which joins said proximal end to said structure at the level of the floor of the upper of said two levels.

* * * * *